US009500423B2

(12) United States Patent
Wilkinson et al.

(10) Patent No.: US 9,500,423 B2
(45) Date of Patent: Nov. 22, 2016

(54) METHOD AND MECHANISM FOR AUTOMATIC REGULATION OF GAS FLOW WHEN MOUNTING A SUPPRESSOR TO A FIREARM

(71) Applicant: RA Brands, L.L.C., Madison, NC (US)

(72) Inventors: Lucas T. Wilkinson, Cecilia, KY (US); David O. Matteson, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 85 days.

(21) Appl. No.: 14/603,614

(22) Filed: Jan. 23, 2015

(65) Prior Publication Data

US 2016/0216055 A1 Jul. 28, 2016

Related U.S. Application Data

(60) Provisional application No. 61/931,069, filed on Jan. 24, 2014.

(51) Int. Cl.
*F41A 5/26* (2006.01)
*F41A 5/28* (2006.01)

(52) U.S. Cl.
CPC ... *F41A 5/26* (2013.01); *F41A 5/28* (2013.01)

(58) Field of Classification Search
CPC ..... F41A 5/26–5/28
USPC ..... 89/193
See application file for complete search history.

(56) References Cited

U.S. PATENT DOCUMENTS

| | | | |
|---|---|---|---|
| 678,969 | A | 7/1901 | McClean |
| 960,825 | A | 6/1910 | Colleoni |
| 1,846,993 | A | 2/1932 | Destree |
| 2,416,287 | A | 2/1947 | Coates et al. |

(Continued)

FOREIGN PATENT DOCUMENTS

| | | |
|---|---|---|
| EP | 0 158 707 | 10/1985 |
| EP | 0 380 041 | 8/1990 |

(Continued)

OTHER PUBLICATIONS

Michael O. Humphries, SIG Sauer SIG556 Classic, Aug. 23, 2012, 2 pages, National Rifle Association, http://www.americanrifleman,org/ArticlePage.aspx?id=1661&cid=4.

(Continued)

*Primary Examiner* — Stephen M Johnson
*Assistant Examiner* — Joshua Semick
(74) *Attorney, Agent, or Firm* — Womble Carlyle Sandridge & Rice, LLP

(57) ABSTRACT

A gas system includes a gas block having a gas port for directing propellant gases received from a gas port of a barrel of a firearm into the gas system to cycle an auto loading feature of the firearm. A spring-loaded plunger assembly positioned within the gas block includes a plunger component having a plurality of gas ports and a plunger cap at a forward end, wherein the position of the plunger component within the gas block automatically controls an amount of gas that is allowed to enter the gas system. Mounting a suppressor to the muzzle of the barrel depresses the plunger cap and drives it linearly rearward causing the plunger component to rotate to automatically restrict the volume of propellant gases directed into the gas system through a restricted flow gas port in the plunger component.

19 Claims, 12 Drawing Sheets

(56) References Cited

U.S. PATENT DOCUMENTS

| | | | | |
|---|---|---|---|---|
| 2,685,891 | A | 8/1954 | Segelhorst et al. | |
| 2,750,849 | A | 6/1956 | Harvey | |
| 2,800,059 | A | 7/1957 | Miller | |
| 2,987,967 | A | 6/1961 | Wild et al. | |
| 3,020,807 | A | 2/1962 | Hailston at al. | |
| 3,058,400 | A | 10/1962 | Hailston et al. | |
| 3,127,812 | A | 4/1964 | Into et al. | |
| 3,568,564 | A | 3/1971 | Badali | |
| 3,968,727 | A | 7/1976 | Hyytinen | |
| 3,990,348 | A | 11/1976 | Vesamaa | |
| 4,085,654 | A | 4/1978 | Panigoni | |
| 4,102,243 | A | 7/1978 | Jennie | |
| 4,125,054 | A | 11/1978 | Jennie | |
| 4,174,654 | A | 11/1979 | Liedke | |
| 4,373,423 | A | 2/1983 | Moore | |
| 4,389,920 | A | 6/1983 | Dufour, Sr. | |
| 4,414,880 | A | 11/1983 | Throner | |
| 4,702,146 | A | 10/1987 | Ikeda et al. | |
| 4,872,392 | A | 10/1989 | Powers et al. | |
| 4,901,623 | A | 2/1990 | Lee | |
| 5,218,163 | A | 6/1993 | Dabrowski | |
| 5,272,956 | A | 12/1993 | Hudson | |
| 5,388,500 | A | 2/1995 | Petrovich | |
| 5,959,234 | A | 9/1999 | Scaramucci et al. | |
| 6,374,720 | B1 | 4/2002 | Tedde | |
| 6,508,160 | B2 | 1/2003 | Beretta | |
| 6,715,396 | B2 | 4/2004 | Dionne | |
| 6,848,351 | B1 | 2/2005 | Davies | |
| 6,971,202 | B2 | 12/2005 | Bender | |
| 6,973,863 | B1 | 12/2005 | Jones | |
| 7,258,056 | B2 | 8/2007 | Guesnet et al. | |
| 7,661,349 | B1 | 2/2010 | Brittingham | |
| 7,810,423 | B2 * | 10/2010 | Monroe | F41A 3/62 89/193 |
| 7,856,917 | B2 | 12/2010 | Noveske | |
| 7,891,282 | B1 | 2/2011 | DeGroat | |
| 7,891,284 | B1 * | 2/2011 | Barrett | F41A 5/28 89/14.4 |
| 7,905,171 | B1 | 3/2011 | Brittingham | |
| 7,926,404 | B2 | 4/2011 | Brittingham | |
| 7,942,090 | B1 | 5/2011 | Hoffman | |
| 7,946,214 | B2 | 5/2011 | Stone | |
| 8,042,448 | B1 | 10/2011 | Sylvester et al. | |
| 8,061,260 | B2 | 11/2011 | Kenney et al. | |
| 8,065,949 | B1 | 11/2011 | Molinari | |
| 8,109,194 | B2 | 2/2012 | Stone | |
| 8,161,864 | B1 | 4/2012 | Vuksanovich | |
| D661,364 | S | 6/2012 | Kenney et al. | |
| 8,201,489 | B2 | 6/2012 | Juarez | |
| 8,245,625 | B2 | 8/2012 | Winge | |
| 8,250,964 | B2 | 8/2012 | Stone | |
| 8,261,653 | B2 | 9/2012 | Crommett | |
| 8,264,653 | B2 | 9/2012 | Oh et al. | |
| 8,316,756 | B1 | 11/2012 | Woodell et al. | |
| 8,387,299 | B1 | 3/2013 | Brittingham et al. | |
| 8,393,259 | B2 | 3/2013 | Larue | |
| 8,424,441 | B2 | 4/2013 | Brittingham et al. | |
| 8,528,458 | B2 | 9/2013 | Windauer | |
| 8,701,543 | B2 * | 4/2014 | Brinkmeyer | F41A 5/28 89/191.01 |
| 8,887,616 | B2 | 11/2014 | Kenney | |
| 8,950,313 | B2 | 2/2015 | Kenney | |
| 9,328,981 | B2 * | 5/2016 | Kenney | F41A 5/28 |
| 2005/0115398 | A1 | 6/2005 | Olson | |
| 2006/0278205 | A1 | 12/2006 | Axelsson | |
| 2009/0229454 | A1 | 9/2009 | Fluhr et al. | |
| 2010/0071541 | A1 | 3/2010 | Barrett | |
| 2010/0275770 | A1 | 11/2010 | Noveske | |
| 2011/0107900 | A1 | 5/2011 | Presz et al. | |
| 2012/0167749 | A1 | 7/2012 | Young | |
| 2012/0167756 | A1 | 7/2012 | Larue | |
| 2012/0167757 | A1 | 7/2012 | Gomez | |
| 2012/0317860 | A1 * | 12/2012 | Langevin | F41G 1/033 42/111 |
| 2013/0098235 | A1 | 4/2013 | Reinken | |
| 2014/0076143 | A1 | 3/2014 | Hall | |
| 2014/0076150 | A1 | 3/2014 | Brinkmeyer et al. | |
| 2015/0292825 | A1 * | 10/2015 | Cassels | F41A 5/28 89/193 |

FOREIGN PATENT DOCUMENTS

| | | |
|---|---|---|
| GB | 2 072 310 | 9/1981 |
| WO | WO 2010-111109 | 9/2010 |
| WO | WO 2010-123604 | 10/2010 |

OTHER PUBLICATIONS

Jacob Gottfredson, Standing ready: Sig Sauers 516 patrol rifle, Guns Magazine, Mar. 1, 2012, pp. 68-70, vol. 58, issue 3, Publishers Development Corporation.

International Search Report dated Jul. 23, 2014 for International Application No. PCT/US2014/010073 filed Jan. 2, 2014.

Written Opinion dated Jul. 23, 2014 for International Application No. PCT/US2014/010073 filed Jan. 2, 2014.

International Search Report dated Apr. 11, 2014 for International Application No. PCT/US2014/010090 filed Jan. 2, 2014.

Written Opinion dated Apr. 11, 2014 for International Application No. PCT/US2014/010090 filed Jan. 2, 2014.

* cited by examiner

METHOD AND MECHANISM FOR AUTOMATIC REGULATION OF GAS FLOW WHEN MOUNTING A SUPPRESSOR TO A FIREARM

CROSS-REFERENCE TO RELATED APPLICATION

This application claims the benefit of U.S. Provisional Application No. 61/931,069 filed Jan. 24, 2014, the entire disclosure of which is incorporated herein by reference.

TECHNICAL FIELD

The embodiments of the invention generally relate to gas operating systems for firearms and, more particularly, to automatic gas regulation systems for firearms.

BACKGROUND OF THE INVENTION

Semi-automatic firearms, such as rifles and shotguns, are designed to fire a round of ammunition, such as a cartridge or shotshell, in response to each squeeze of the trigger of the firearm, and thereafter automatically load the next shell or cartridge from the firearm magazine into the chamber of the firearm. During firing, the primer of the round of ammunition ignites the propellant (powder) inside the round, producing an expanding column of high pressure gases within the chamber and barrel of the firearm. The force of this expanding gas propels the bullet/shot of the cartridge or shell down the barrel.

In semi-automatic and automatic rifles and shotguns that rely on such gases from firing to drive operation of the firearm, gas from a fired cartridge is directed to a gas piston or the bolt carrier to cycle the action of the firearm. For example, upon firing a cartridge in a firearm having a direct gas impingement system, high-temperature, high-pressure gas follows the exiting projectile down the barrel; and a portion of the gas from the fired cartridge travels into a port and along a gas tube, rearwardly to a gas key that is coupled to the bolt carrier and includes an internal port to allow the high-pressure gas to flow against the bolt carrier. As the gas expands, the pressure from the gas drives the bolt carrier and bolt apart. The bolt carrier and bolt continue to be driven apart until the bolt rotates following the cam path and unlocks from the barrel extension. The bolt carrier and bolt then translate rearwardly against the return spring located in the buttstock, extracting the empty cartridge. Thereafter, forward movement of the bolt and bolt carrier by the return spring loads a next cartridge from the ammunition magazine and returns the bolt. The bolt returns to a locked position for firing.

In standard auto loading rifles, the addition of a suppressor to the muzzle of the firearm can generate an increase in bore pressure, causing the rifle to cycle faster than it would normally cycle if the suppressor were not installed. In known systems, the operator manually switches a gas regulating device to modify the operating characteristics of the firearm to compensate for this increased bore pressure. This manual switch will typically have a lever or rotational plug that requires the operator to manually switch the system from one setting to the other. In a manually switched gas system, gases are either diverted (bled off) or restricted in order to reduce the overall energy available to operate the firearm.

SUMMARY

The embodiments disclosed are directed to a system and method in which the action of installing a suppressor on the firearm directly actuates a regulating mechanism to reduce the initial energy available to a gas operating system and to match operating speeds between suppressed and unsuppressed operation of the firearm.

In an autoloading firearm, installing a suppressor on the firearm will typically cause the cyclic operation of the firearm to speed up due to residual pressures in the suppressor and bore of the firearm. Commonly available systems require the manual activation of a regulator to reduce the initial energy available to the operating system to balance the extra energy imparted by the residual bore pressure.

In one embodiment, an auto regulating gas system is provided for an auto loading firearm wherein the firearm includes a barrel having a bore, at least one gas port, and a muzzle. The gas system includes a gas block attached to the barrel to redirect a volume of propellant gases to cycle the auto loading firearm, the gas block including at least one gas port for directing propellant gases received from the at least one gas port of the barrel into the gas system to cycle the auto loading firearm. A spring-loaded plunger assembly is at least partially positioned within the gas block. The plunger assembly includes a plunger component having a plurality of gas ports and a plunger cap at a forward end, the plunger cap having at least one of a cam pin and a cam path, wherein the position of the plunger component within the gas block automatically controls an amount of gas that is allowed to enter the gas system. Mounting a suppressor to the muzzle depresses the plunger cap and drives it linearly rearward causing the plunger component to rotate as the cam pin travels along the cam path to automatically restrict the volume of propellant gases directed into the gas system through a restricted flow gas port in the plunger component.

In another embodiment, an auto regulating gas system for an auto loading firearm is provided, including a gas block attached to the barrel and configured to redirect a volume of propellant gases to cycle the operation of the firearm, the gas block having at least one gas port for directing propellant gases received from at least one gas port of the barrel into the gas system; a flow regulator at least partially positioned in the gas block, the flow regulator comprising a regulator body rotatably positioned in a passageway connected to the at least one gas port of the gas block, wherein a position of the regulator body in the passageway controls an amount of gas that is allowed to enter the gas system; and a linkage comprising a plunger part configured to extend forwardly from the gas block for being engaged and moved rearwardly by a suppressor mounted to the muzzle end of the firearm barrel. The linkage further generally will be configured to rotate the regulator body in the passageway by an amount as needed to control an amount of gas that is allowed to enter the gas system in response to the plunger part being engaged and moved rearwardly by the suppressor mounted to the muzzle.

Another aspect of this disclosure is the provision of a method of regulating a gas system for an auto loading firearm. Such a method will include mounting a suppressor to a muzzle of a barrel of the firearm wherein a linkage is engaged by the suppressor in response to the mounting of the suppressor to the muzzle of the barrel of the firearm. The linkage is operable to rotate a flow regulator in response to the linkage being engaged by the suppressor mounted to the muzzle. The flow regulator is operable to adjust an amount of gas that is allowed to enter the gas system in response to the rotation of the flow regulator.

BRIEF DESCRIPTION OF THE DRAWINGS

The above-discussed and other advantages and aspects of the embodiments of the disclosure will become apparent and more readily appreciated from the following detailed description of the embodiments taken in conjunction with the accompanying drawings, as follows.

DETAILED DESCRIPTION

The following description is provided as an enabling teaching of embodiments of the invention including the best, currently known embodiment. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the invention and not in limitation thereof, since the scope of the invention is defined by the claims.

As described in the embodiments herein, the use of a cam path to transfer linear or translatory motion of the plunger cap or part into rotational motion of the plunger component or flow regulator body is a unique feature that regulates the amount of propellant gas being allowed to enter the gas tube when a suppressor is attached to the end of the firearm muzzle. The disclosed embodiments improve the reliability and durability of the firearm when operating in a suppressed condition or mode. This provides the further advantage of the firearm being less prone to carbon fouling which causes the mechanism to become stuck in one position.

Figure 1A:
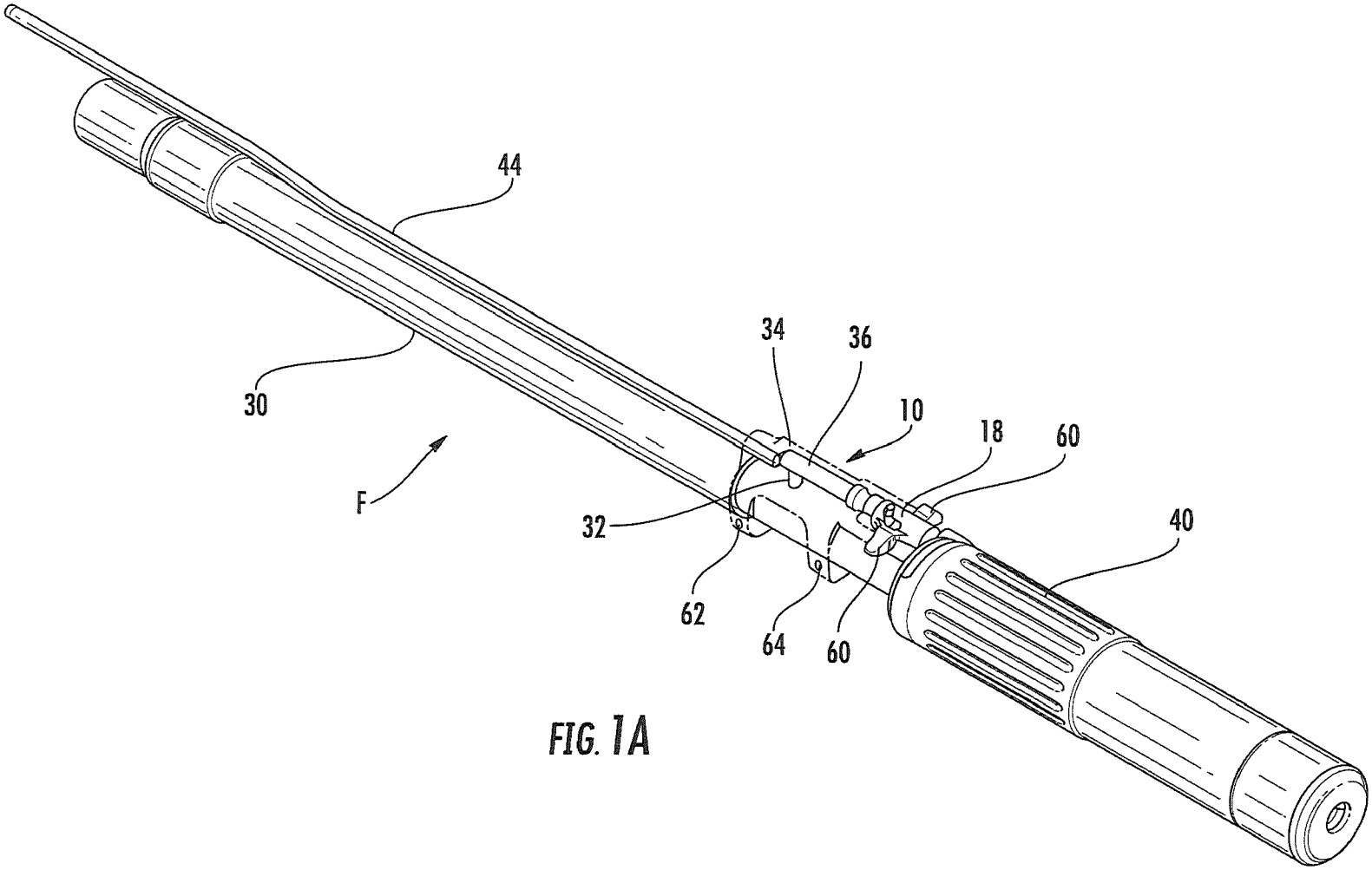
FIG. 1A illustrates an isometric view of the auto regulating gas system and linkage in an exemplary embodiment.
Figure 1B:
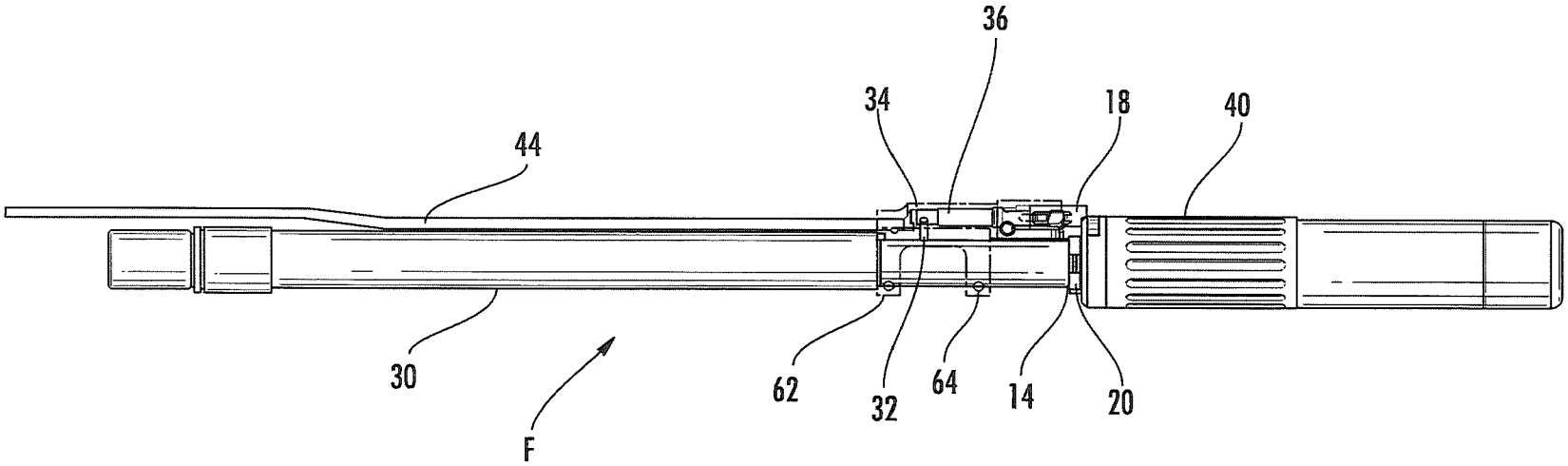
FIGS. 1B-1G depict various elevation views of the auto regulating gas system and linkage in an exemplary embodiment.
Figure 1C:
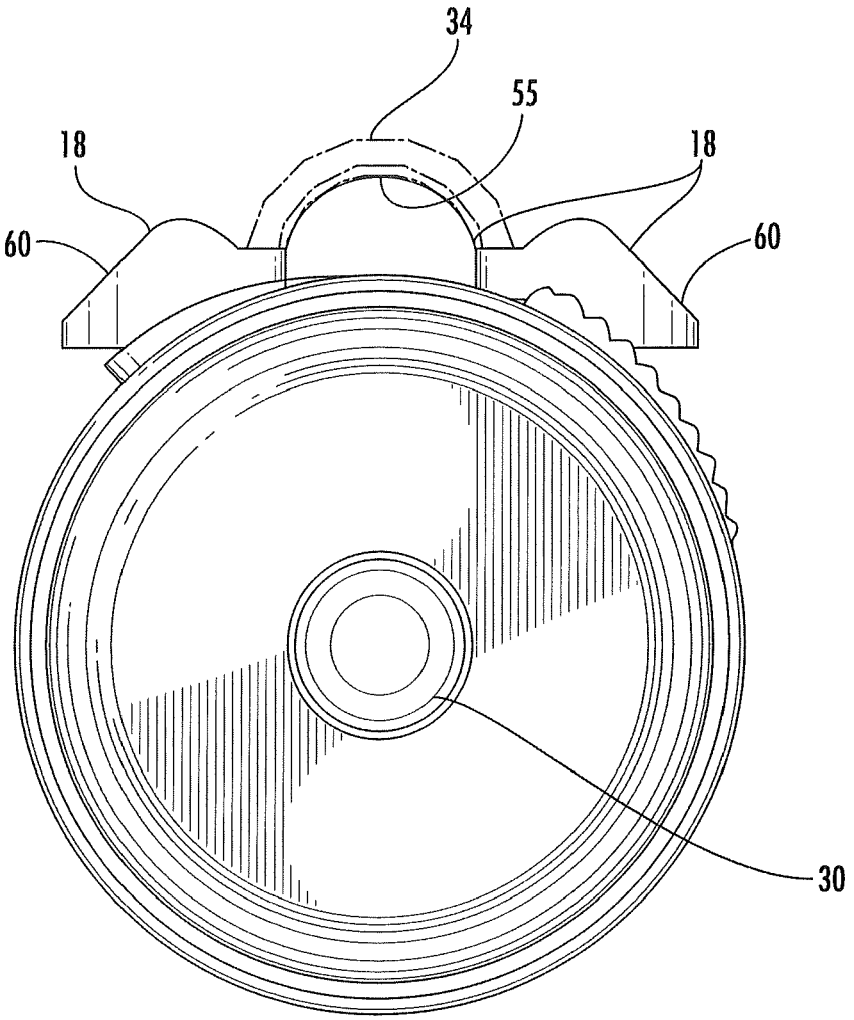
Figure 1D:
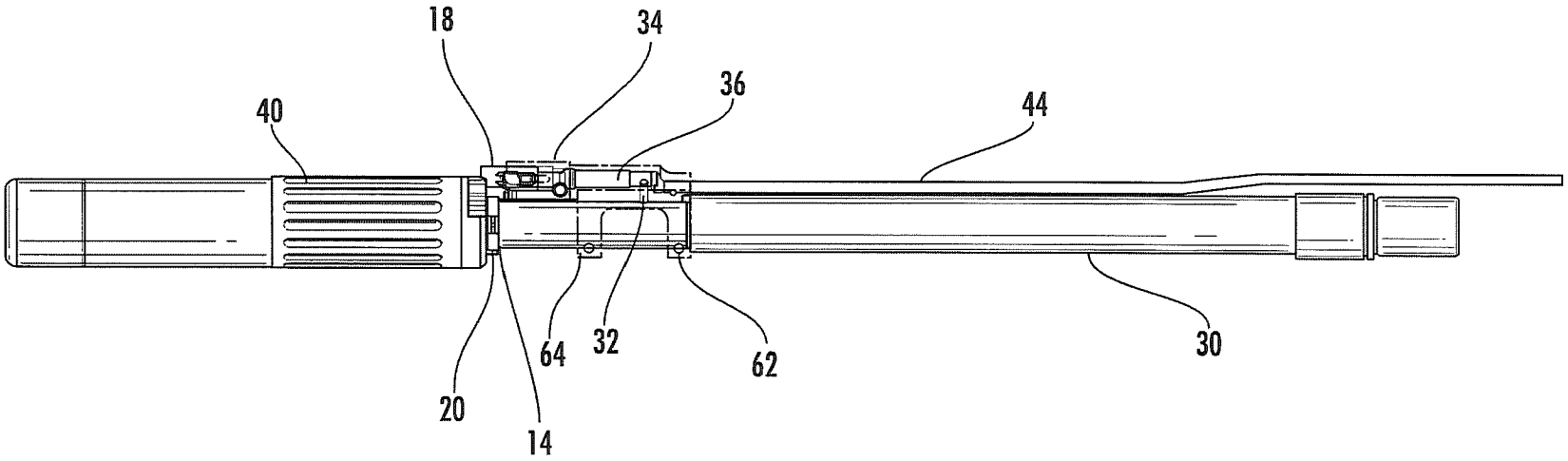
Figure 1E:
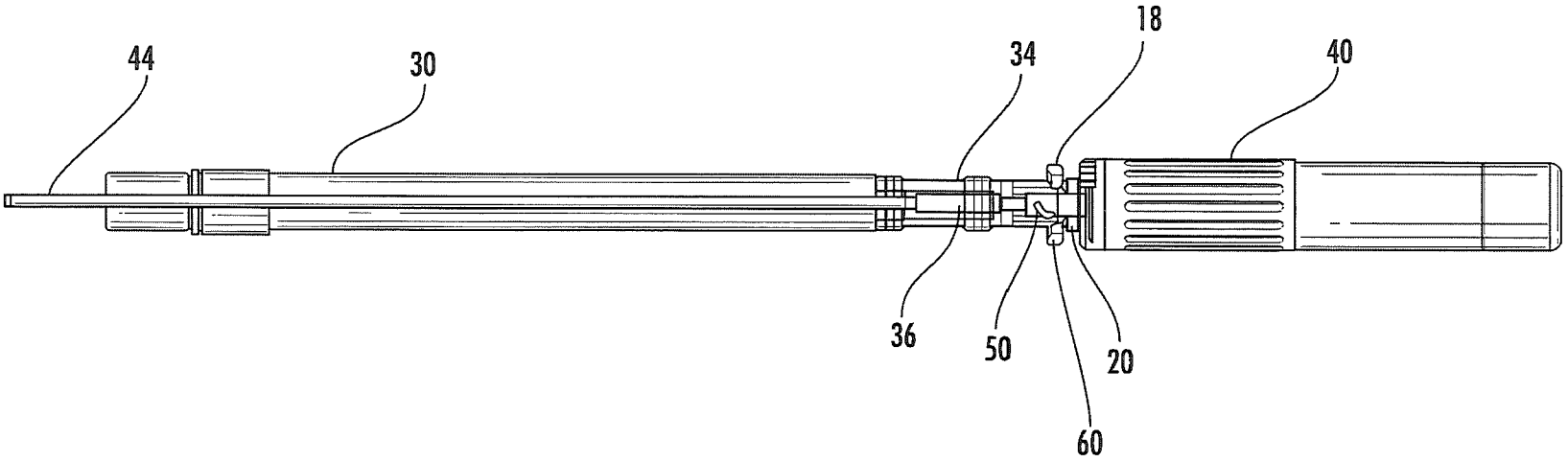
Figure 1F:
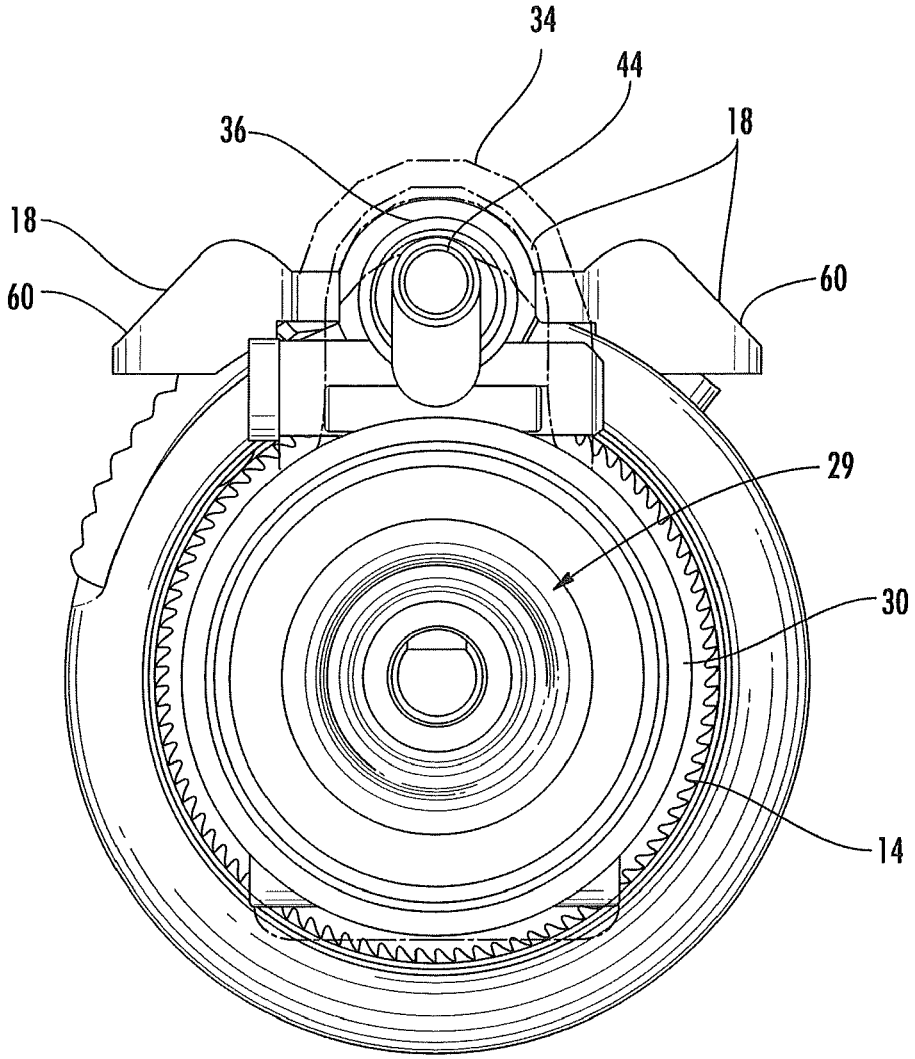
Figure 1G:
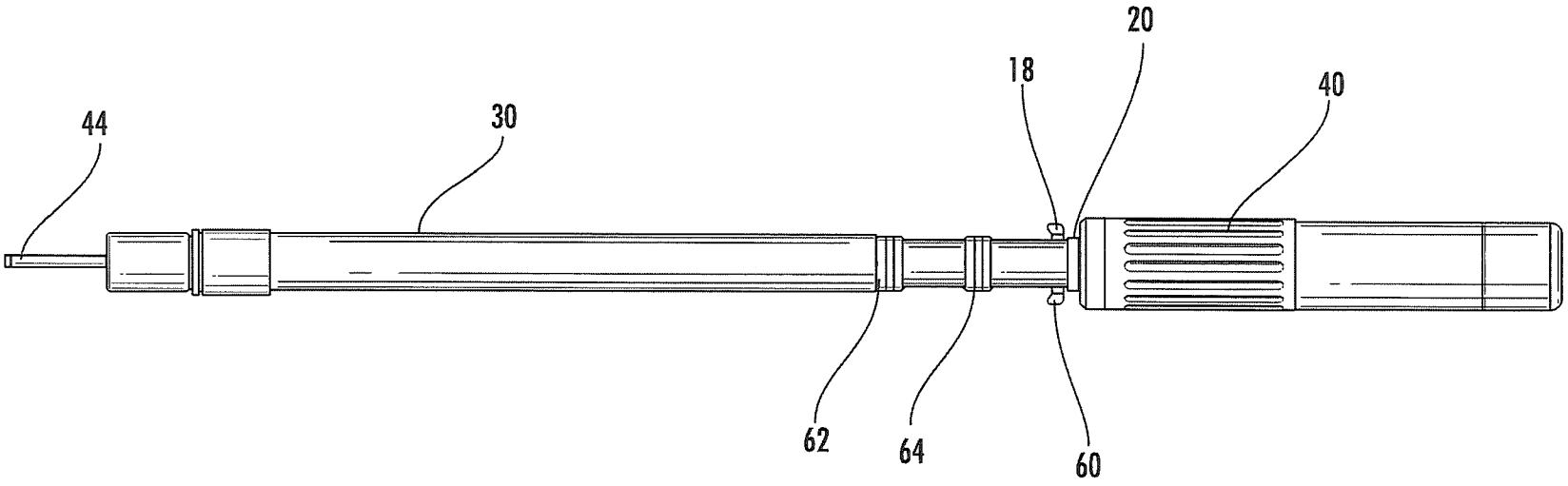

FIG. 1A illustrates an isometric view of the auto regulating gas system and linkage in one embodiment. FIGS. 1B-1G depict various elevation views of the auto regulating gas system and linkage in an exemplary embodiment. Specifically, relative to the orientation of the isometric view of FIG. 1A, FIG. 1B shows a front side view; FIG. 1C shows a right side view; FIG. 1D shows a back side view; FIG. 1E shows a top view; FIG. 1F shows a left side view; and FIG. 1G shows a bottom view of the firearm. The gas-operated mechanism of an auto loading firearm F can be adjusted automatically using a flow regulating mechanism or plunger assembly 10 when an accessory is attached to the muzzle 14 of the firearm. The flow regulator or plunger assembly 10 includes a plunger part or cap 18 that is mounted for reciprocating movement, and a plunger component 36. The plunger component 36 is capable of rotation and includes at least two orifices, ports or other guideways or passages that control the flow of propellant gas into the gas tube 44 during operation of the firearm. The barrel 30 of the firearm comprises a chamber to accept a cartridge, a bore 29 (FIGS. 1F and 2), one or more gas orifices or ports 31 (FIG. 2), and the muzzle 14.

A gas block 34 can be attached to the barrel 30 to redirect the propellant gases to cycle the action of the firearm F through the use of a gas tube 44 that redirects the gases into the bolt carrier (not shown). Pins 62, 64 or one or more other suitable fasteners retain the gas block 34 to the barrel 30. FIGS. 1B-1G schematically illustrate the body of the gas block 34, with portions of the body of the gas block being shown as being transparent or see through, and/or with portions of the body of the gas block being omitted, such as for illustrating features of the auto regulating gas system and linkage that may be normally hidden from view within the gas block.

The barrel 30 of the auto loading firearm F may have a suppressor 40 attached to its muzzle end 14. Attaching the suppressor 40 to the muzzle 14 forces the plunger part or cap 18 to move linearly rearward which rotates the plunger component 36 in order to restrict the amount of gas entering the gas tube 44, thereby reducing the amount of energy used to cycle the firearm.

Figure 2:
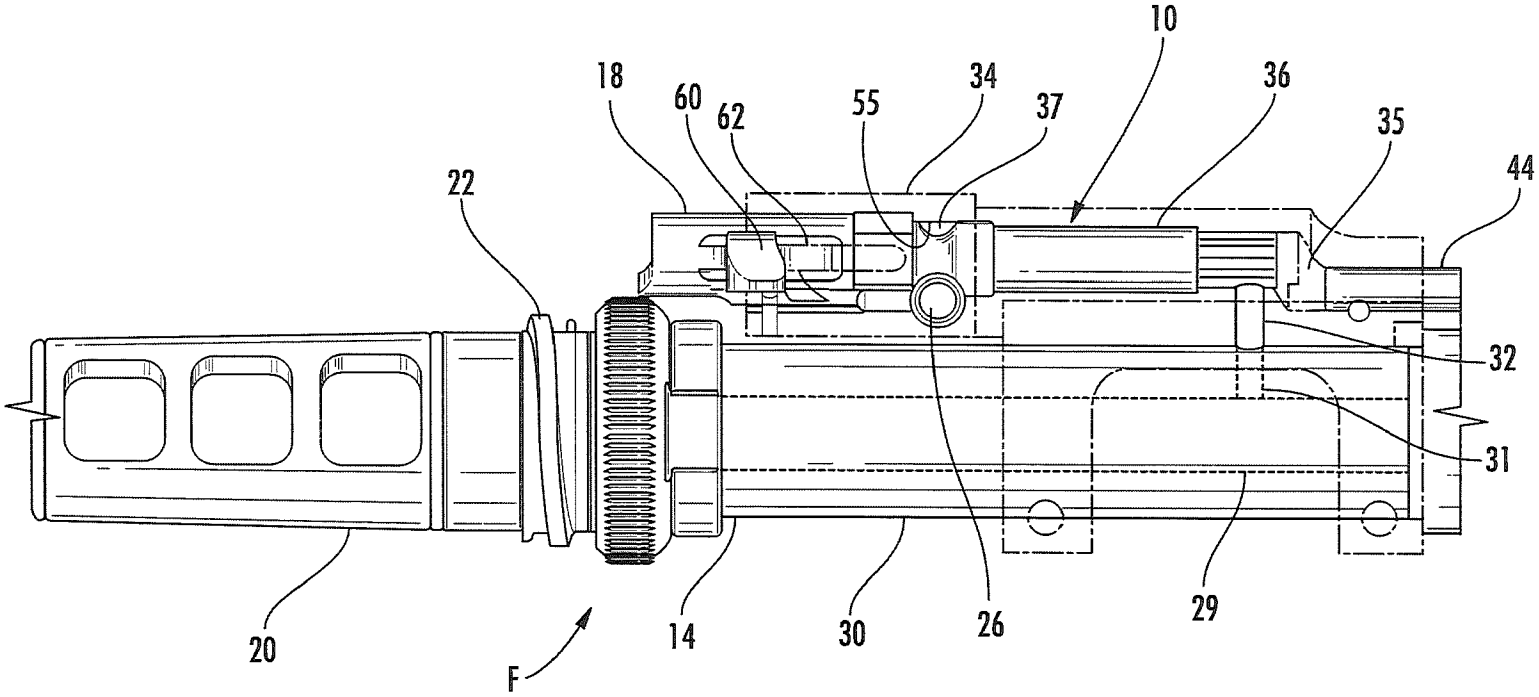
FIG. 2 illustrates a side view of the auto regulating gas system and linkage in an unsuppressed setting in an exemplary embodiment.
Figure 3:
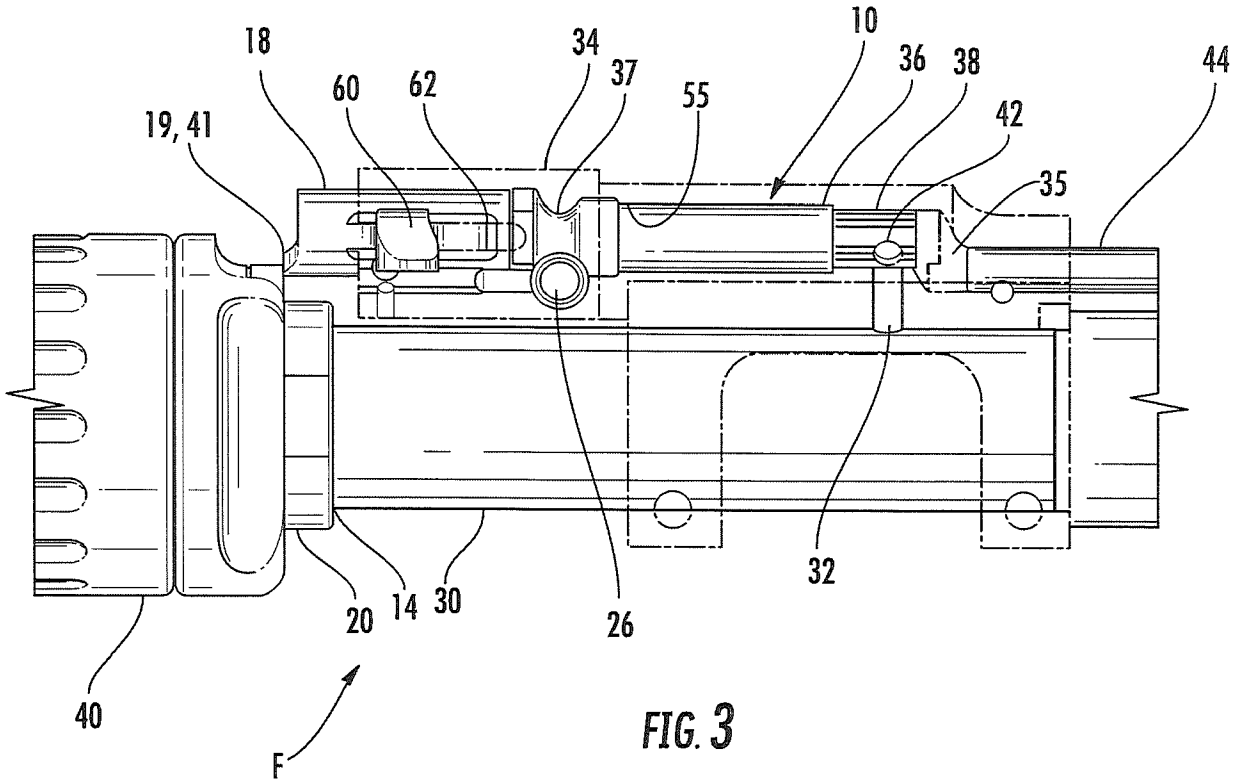
FIG. 3 illustrates a side view of the auto regulating gas system and linkage in a suppressed setting in an exemplary embodiment.

FIG. 2 illustrates a side view of the auto regulating gas system and linkage in an unsuppressed setting or condition in one embodiment. FIG. 3 illustrates a side view of the auto regulating gas system and linkage in a suppressed setting or condition. As shown in FIG. 3, a rear end 41 of the suppressor 40 is engaged against a front end 19 of the plunger part or cap 18, so that the plunger part or cap is pressed farther into the gas block in FIG. 3 as compared to FIG. 2. The plunger part or cap 18 can be depressed or moved rearwardly in response to the suppressor 40 being mounted to the muzzle 14, because this mounting can cause the rear end 41 of the suppressor 40 to be engaged against the front end 19 of the plunger part or cap 18.

As shown in FIGS. 2-3, gas block 34 is mounted to the barrel 30 of a semi-automatic or fully automatic firearm F. In FIG. 2, a muzzle device 20 (e.g., flash hider) is attached to the muzzle end 14 of the barrel 30 of the firearm F. For example, the muzzle device 20 may be attached to the muzzle 14 by way of a threaded or other releasable connection, and which can comprise a cooperative, direct engagement between at least one internal helical thread of the muzzle device and at least one external helical thread of the muzzle. Such an attachment alternatively may be provided in any other suitable manner.

Gas from at least one port 31 (FIG. 2) in the barrel 30 will enter the gas block 34 through at least one gas port 32 and is routed through a gas tube 44 back to the bolt carrier (not shown). The spring-loaded plunger assembly 10 includes the plunger part or cap 18 which protrudes from the front of the gas block 34. A cross pin 26 extends at least partially through the gas block 34 and into an outer annular groove 37 in a shaft of the plunger component 36 to at least partially retain the plunger component 36 inside of the gas block in a manner that allows rotation of the plunger component inside of the gas block but restricts translational movement of the plunger component 36. The rearward end section of the plunger component 36 may be referred to as a flow regulator body 38 that is in communication with the gas port 32 such that gas flow from the barrel 30 into the gas block 34 must pass by or through the regulator body 38 of the plunger component 36 before entering the gas tube 44. The plunger assembly 10 is designed so that rotation of the plunger component 36, and/or the rotation of the flow regulator body 38 thereof, will cause an expansion or constriction of the area through which the gas can pass on its way to the gas tube 44. The plunger cap 18 of the plunger assembly 10 at least partially includes a cam-type mechanism (shown in FIG. 6) that transitions linear motion of the plunger cap 18 into rotational motion of the plunger component 36.

A suppressor 40 may be mounted to the muzzle 14 of the barrel 30 in any suitable manner, such as by being mounted directly to the muzzle by way of a threaded connection comprising cooperative, direct engagement between at least one internal helical thread of the suppressor and at least one external helical thread of the muzzle, or the suppressor may be indirectly mounted to the muzzle. For example, FIGS. 1B, 1D, 1E, 1F, 1G and 3 show the suppressor 40 mounted to a flash hider or suppressor or similar device 20 that is already mounted on the muzzle end 14 of the barrel 30, such as by way of a threaded connection comprising cooperative, direct engagement between at least one internal helical thread of the suppressor and at least one external helical thread 22 of the muzzle device, wherein these threads are cooperatively configured for causing relative axial movement between the suppressor 40 and the muzzle 14 of the barrel 30 in response to relative rotation therebetween. Alternatively, the suppressor 40 may be mounted to the muzzle 14 of the barrel 30 in any other suitable manner. Additionally, other suppressor designs or configurations also can be used.

In one embodiment shown in the drawings, the gas block 34 can be located and/or configured so that when a suppressor 40, as shown in FIG. 3, is mounted over a flash hider or other device 20 that is already mounted on the muzzle end 14 of the barrel 30, the suppressor 40 depresses the plunger part or cap 18, which causes the plunger component 36 to rotate, thereby constricting the amount of gas reaching the gas tube 44. Alternatively, the gas block 34 and/or other features may be located or configured so that when a suppressor 40 is mounted directly to the muzzle 14 of the barrel, the suppressor 40 depresses the plunger cap 18, which causes the plunger component 36 to rotate, thereby constricting the amount of gas reaching the gas tube 44.

Figure 4:
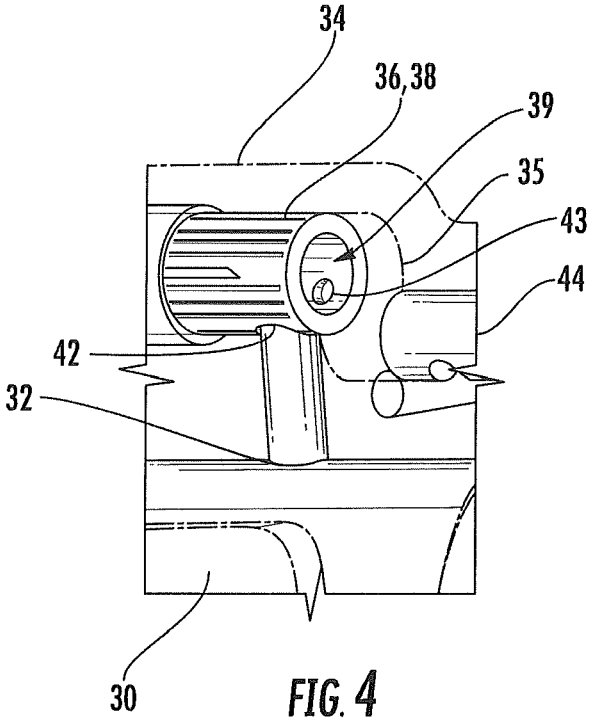
FIG. 4 illustrates a side view of a plunger in an unsuppressed setting in an exemplary embodiment. This shows that the plunger in a normal position does not restrict flow of gas within the gas block from the gas port to the gas tube.

FIG. 4 illustrates a side view of the plunger component 36 in an unsuppressed setting, condition or state, in one embodiment. As best understood with reference to FIG. 4, a relatively large gas port 42 that extends through the sidewall of the regulator body 38 is aligned with and open to an end of the gas block's gas port 31, the regulator body's large gas port 42 is open to a rearwardly open cavity 39 of the regulator body 38, and the regulator body's cavity 39 is open to the interior of the gas tube 44 by way of an internal passage 35 defined in the gas block 34. The regulator body 38 may be positioned in the passage 35 or in a bore, cavity or other passageway that is open to the passageway 35. The plunger component 36 also can be configured so that it does not restrict flow of gas within the gas block 34 from the gas port 32 to the gas tube 44. The regulator or plunger assembly 10 may be positioned in and protrude forwardly out of a longitudinally extending main passageway or bore 55 in the gas block 34, wherein this longitudinally extending main bore 55 extends forward from the internal passage 35, and the internal passage 35 may be a rear portion of the longitudinally extending main bore 55 of the gas block.

Figure 5:
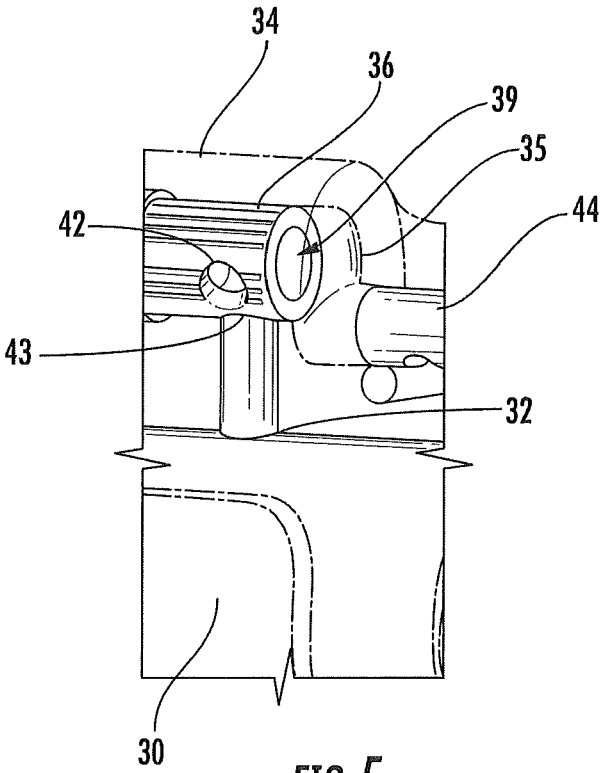
FIG. 5 illustrates a side view of a plunger in a suppressed setting in an exemplary embodiment. This shows that the rotated plunger restricts flow of gas within the gas block from the gas port to the gas tube.

FIG. 5 illustrates a side view of the plunger component 36 in a suppressed setting or state. As compared to FIG. 4, in the configuration shown in FIG. 5 the plunger component 36 including the regulator body 38 has rotated to a position where gas traveling from the gas port 32 to the gas tube 44 is regulated/constricted by relatively small gas port 43 in the regulator body 38 of the plunger component 36. The small gas port 43 can be smaller than both the gas port 32 in the gas block 34 and the relatively large gas port 42 of the regulator body 38, thus reducing the amount of gas allowed to drive the system. Opening 43 is also referred to herein as restricted flow gas port 43. As shown in FIG. 5, the relatively small gas port 43 that extends through the sidewall of the regulator body 38 is aligned with and open to an end of the gas block's gas port 31, the regulator body's small gas port 43 is open to the rearwardly open cavity 39 of the regulator body 38, and the regulator body's cavity 39 is open to the interior of the gas tube 44 by way of the internal passage 35 defined in the gas block 34. In a suppressed setting or state, the regulator body's large gas port 42 is obstructed or closed relative to the gas block's gas port 31. In the unsuppressed setting or state, the regulator body's small gas port 43 is obstructed or closed relative to the gas block's gas port 31.

Figure 6:
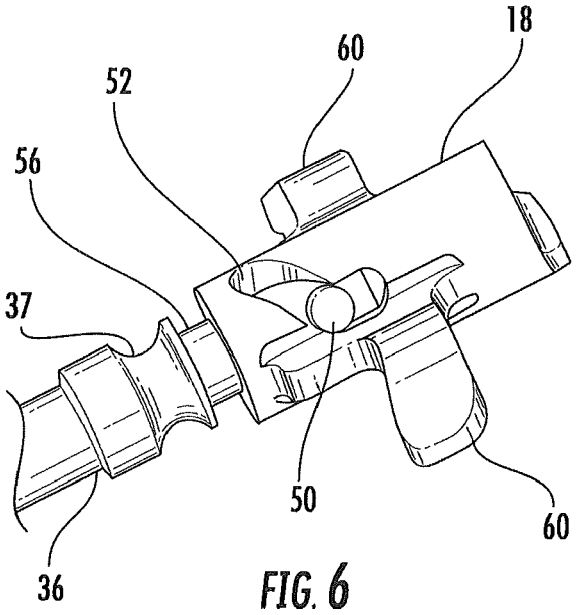
FIG. 6 illustrates an interface for the cam pin-plunger-plunger cap in an exemplary embodiment.

FIG. 6 illustrates an interface for the cam pin-plunger-plunger cap in an exemplary embodiment. As shown in FIG. 6, a cam follower or pin 50 fixedly connected to and extending outwardly from a forward portion of the plunger component 36 extends into and is guided by the cam or cam path 52 that is machined into the plunger cap 18, wherein the cam pin and path 50, 52 are cooperative for controlling relative axial and rotational movement between the plunger cap 18 and the plunger component 36. This demonstrates an example of how a linkage that may comprise the plunger cap 18, plunger component 36, cam pin 50 and cam path 52 can convert linear translation of the plunger cap 18 into rotational movement of the regulator body 38 of the plunger component 36.

Figure 7:
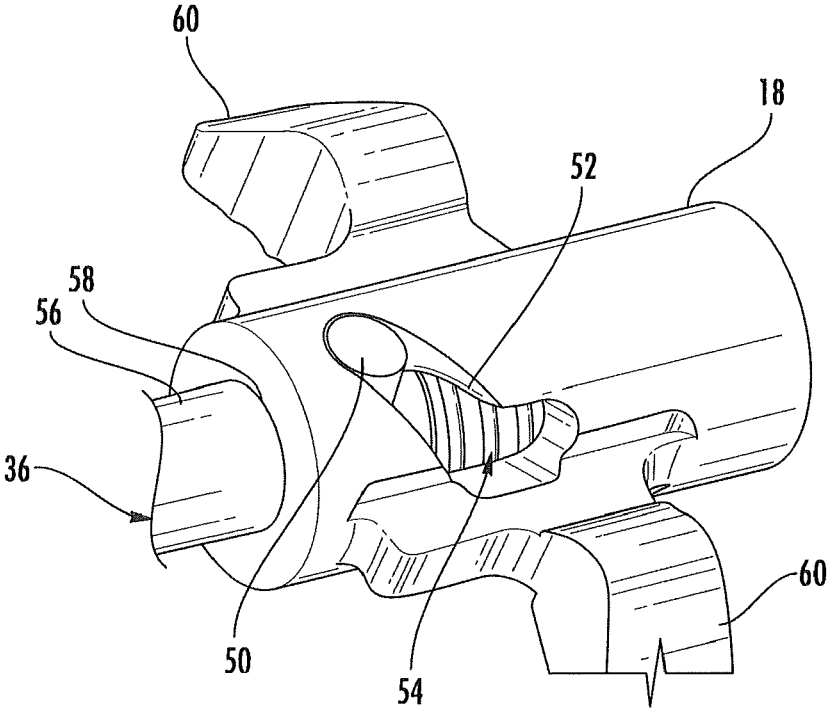
FIG. 7 illustrates a location of the plunger spring in an exemplary embodiment.

As best understood with reference to FIG. 7, a substantially cylindrical forward shaft 56 of the plunger component 36 extends through a substantially cylindrical opening 58 in the rear end of the plunger cap 18, with the outer diameter of the shaft 56 being slightly smaller than the diameter of the opening 58 for allowing both relative axial and rotational movement between the plunger cap 18 and the plunger component 36. The cam pin 50 and cam path 52 are cooperative for restricting yet allowing predetermined relative axial and rotational movement between the plunger cap 18 and the plunger component 36. FIG. 7 illustrates at least one plunger spring 54 positioned within an internal chamber or cavity within the plunger cap 18. The plunger spring 54 provides constant tension between the plunger cap 18 and the plunger component 36 so that the plunger component 36 does not move under normal operation of the firearm. The spring 54 presses the plunger cap 18 and the plunger component 36 away from one another, but the cam pin 50 and cam path 52 prevent the plunger cap 18 from traveling off the end of the shaft 56 of the plunger component 36.

Due to the large amount of carbon and combustion by-product build-up that can occur in gas blocks, this embodiment is superior to prior plunger devices that rely solely on linear motion of a plunger to constrict flow from the gas block. As fouling and carbon build-up occurs in the gas block, prior plunger devices can prevent a linear plunger from translating properly. As disclosed herein, linear motion of the plunger cap 18 causes rotational motion of the plunger component 36 via a cam pin 50 and cam path 52. It only takes a very slight rotational motion of the plunger component 36 to change the gas setting, reducing the likelihood that the plunger assembly 10 will get stuck. In one embodiment, the amount of rotation of the plunger component 36 is around 60°.

In operation, a gas block 34 with a spring loaded plunger assembly 10, having one end protruding from the muzzle side of the gas block 34, are attached to firearm F so that when a suppressor 40 is mounted to the muzzle device 20, the suppressor 40 depresses the plunger cap 18. The plunger cap 18 interfaces with the plunger component 36 via a cam pin 50 and cam path 52 that causes the plunger component 36 to be rotated when the cap 18 is translated linearly. When the suppressor 40 is fully attached, the plunger component 36 will have rotated so that the plunger component 36 partially obstructs the flow of gas between the gas port 32 in the gas block 34 and the gas tube 44 via the restricted flow gas port 43 in the plunger component 36. The spring 54 can be located between the plunger component 36 and the plunger cap 18 so that when the suppressor 40 is not mounted to the muzzle device 20, the spring force causes the cap 18 and plunger component 36 to return to their original positions. The plunger assembly 10 is retained within the gas block via a cross pin 26. In one embodiment, the cross pin 26 is retained to the gas block 34 via a spring plunger and has a detent at the open and closed position.

Figure 8:
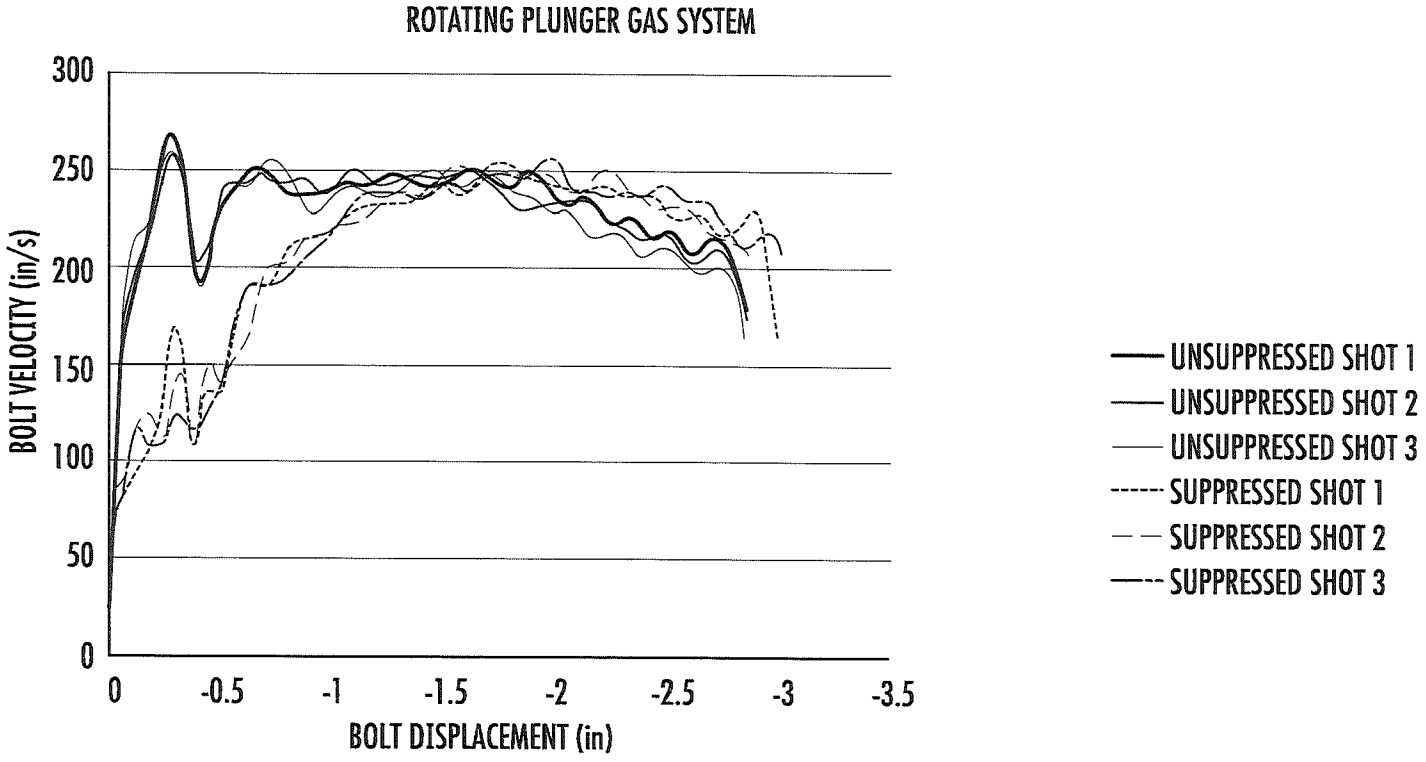
FIG. 8 illustrates a comparison of bolt velocity in the unsuppressed and suppressed conditions with the rotating plunger gas system installed in an exemplary embodiment.

It is known that the addition of a suppressor 40 to a semi-automatic firearm F can have adverse effects on the reliability and durability of the firearm due to the suppressor. As illustrated in FIG. 8, the disclosed embodiments improve firearm reliability by allowing the firearm to maintain the same bolt velocity in both the unsuppressed and suppressed settings.

In one embodiment, the regulator or plunger assembly 10 can be disassembled only when the plunger assembly 10 is removed from the gas block 34. The plunger assembly 10 may be removed from the gas block 34 by at least partially withdrawing the cross pin 26 and then pulling the plunger assembly out of the front of the gas block. Then, the plunger assembly 10 can be disassembled by removing the cam pin 50 from the front shaft 56 of the plunger component 36, so that the plunger cap 18 may be removed from the plunger component 36. More specifically, the plunger cap 18 may be removed from the plunger component 36 by depressing the plunger cap 18 to the bottom of its stroke, and then rotating the plunger component 36 so that an end of the cam pin 50 aligns with a hole in the plunger cap 18, wherein the hole in the plunger cap may be located at the opposite side of the plunger cap from the cam path 52. Once the subject end of the cam pin 50 is aligned with the subject hole, the camp pin can be pushed out from the opposite side via a punch or bullet tip. The cam pin 50 has a shoulder on one end (not shown) to prevent the cam pin 50 from becoming disassembled during operation.

In some embodiments, the gas block 34 could have one or more slot cuts that interface with the plunger cap 18 so as to prevent rotation of the plunger cap 18 during operation. For example, the plunger cap 18 can include one or more wings or lateral protrusions 60 extending outwardly from the body of the plunger cap, wherein the protrusions 60 respectively extend outwardly through forwardly and laterally open slots 62 in the gas block 34.

The plunger cap 18 includes a feature or features that allow the operator to pull the plunger assembly 10 out of the front of the gas block 34 using a bullet tip, fingers, spent cartridge, or other tool. For example and reiterating from above, in one example the plunger assembly 10 may be removed from the gas block 34 by at least partially withdrawing the cross pin 26 and then pulling the plunger assembly out of the front of the gas block.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the present invention. In addition, it is possible to use some of the features of the embodiments disclosed without the corresponding use of the other features. Accordingly, the foregoing description of the exemplary embodiments is provided for the purpose of illustrating the principles of the invention, and not in limitation thereof, since the scope of the invention is defined solely by the appended claims.

What is claimed:

1. An auto regulating gas system for an auto loading firearm wherein the firearm includes a barrel having a bore, at least one gas port, and a muzzle, the gas system comprising:

a gas block attached to the barrel to redirect a volume of propellant gases to cycle the auto loading firearm, the gas block including at least one gas port for directing propellant gases received from the at least one gas port of the barrel into the gas system to cycle the auto loading firearm; and a spring-loaded plunger assembly at least partially positioned within the gas block, the plunger assembly including a plunger component having a plurality of gas ports, and a plunger cap at a forward end, the plunger cap having at least one cam pin and at least one cam path, wherein the position of the plunger component within the gas block automatically controls an amount of gas that is allowed to enter the gas system;

wherein mounting a suppressor to the muzzle depresses the plunger cap and drives it rearwardly causing the plunger component to rotate as the cam pin travels along the cam path to automatically restrict the volume of propellant gases directed into the gas system through a restricted flow gas port in the plunger component.

2. The auto regulating gas system for an auto loading firearm of claim 1 wherein movement of the plunger assembly to restrict the volume of propellant gases enables the firearm to maintain substantially the same bolt velocity in both an unsuppressed condition and in a suppressed condition.

3. The auto regulating gas system for an auto loading firearm of claim 1 wherein a portion of the plunger cap extends past a front end of the gas block towards the muzzle and is driven rearward when the suppressor is mounted to the muzzle, the rearward movement of the plunger cap rotating the plunger component to reduce a flow of propellant gases into the gas system through the restricted flow gas port.

4. The auto regulating gas system for an auto loading firearm of claim 1 further comprising a cross pin inserted into the plunger assembly for retaining the plunger assembly in position in a bore in the gas block.

5. The auto regulating gas system for an auto loading firearm of claim 1 wherein the gas block comprises at least one slot that interfaces with the plunger cap to prevent rotation of the plunger cap during operation of the firearm.

6. The auto regulating gas system for an auto loading firearm of claim 1 wherein the plurality of gas ports in the plunger component comprises a first gas port that aligns with the at least one gas port in the gas block during unsuppressed operation of the firearm, and wherein the restricted flow gas port aligns with the at least one gas port in the gas block during suppressed operation of the firearm.

7. The auto regulating gas system for an auto loading firearm of claim 1 wherein the spring-loaded plunger assembly further comprises a spring located between the plunger component and plunger cap.

8. The auto regulating gas system for an auto loading firearm of claim 7 wherein the spring returns the plunger component and plunger cap to their original position when the suppressor is removed from the muzzle.

9. The auto regulating gas system for an auto loading firearm of claim 7 wherein the spring provides constant tension between the plunger cap and the plunger component preventing movement of the plunger component during unsuppressed operation of the firearm.

10. An auto regulating gas system for an auto loading firearm including a barrel having a bore, at least one gas port, and a muzzle, the gas system comprising:

a gas block attached to the barrel and including at least one gas port for directing propellant gases received from the at least one gas port of the barrel into the gas system to cycle the auto loading firearm and a passageway connected to the at least one gas port of the gas block;

a flow regulator at least partially positioned in the gas block, the flow regulator comprising a regulator body rotatably positioned in the passageway of the gas block, wherein the position of the regulator body within the passageway controls an amount of gas that is allowed to enter the gas system; and a plunger part configured to project from the gas block a distance sufficient to be engaged and moved rearwardly upon mounting of a suppressor to the muzzle of the firearm barrel;

wherein the regulator body is moved in the passageway of the gas block a distance sufficient to adjust a volume of gas allowed to enter the gas system in response to the plunger part being engaged and moved rearwardly by the suppressor.

11. The auto regulating gas system for an auto loading firearm of claim 10 wherein:

the regulator body is mounted for rotating within the passageway;

the plunger part is mounted for reciprocating; and the gas system further comprises a cam and a cam follower configured to cause rotation of the flow regulator in response to reciprocation of the plunger part.

12. The auto regulating gas system for an auto loading firearm of claim 11 wherein:

the plunger part is biased forwardly by at least one spring; and the regulator body has a plurality of gas ports configured for being respectively open to the at least one gas port in the gas block in response to rotation of the regulator body.

13. The auto regulating gas system for an auto loading firearm of claim 10 wherein movement of the regulator body to adjust the volume of propellant gases allowed to enter the gas system enables the firearm to maintain substantially the same bolt velocity in both an unsuppressed condition and in a suppressed condition.

14. The auto regulating gas system for an auto loading firearm of claim 10 wherein a portion of the plunger part extends past a front end of the gas block towards the muzzle and is driven rearward when the suppressor is mounted to the muzzle, the rearward movement of the portion of the plunger part rotating the regulator body to reduce a flow of propellant gases into the gas system through the at least one gas port of the gas block.

15. The auto regulating gas system for an auto loading firearm of claim 10 further comprising a cross pin engaged between the flow regulator and the gas block for at least partially retaining the flow regulator in the gas block.

16. The auto regulating gas system for an auto loading firearm of claim 10 wherein the gas block comprises at least one slot that interfaces with the plunger cap to restrict rotation of the plunger cap.

17. The auto regulating gas system for an auto loading firearm of claim 10 wherein the regulator body comprises a first gas port that aligns with the at least one gas port in the gas block during unsuppressed operation of the firearm, and wherein the restricted flow gas port aligns with the at least one gas port in the gas block during suppressed operation of the firearm.

18. A method of regulating a gas system for an auto loading firearm, the method comprising:

mounting a suppressor to a muzzle of a barrel of the firearm;

engaging a linkage with the suppressor, and in response, moving the linkage to rotate a flow regulator in a gas flow passage; and adjusting an amount of gas that is allowed to enter the gas system in response to the rotation of the flow regulator.

19. The method of claim 18 wherein the rotating of the flow regulator is comprised of rotating a body of the flow regulator so that a first gas port of the body becomes closed from at least one gas port of a gas block and a second gas port of the body becomes open to the at least one gas port of the gas block.

* * * * *